US005924329A

United States Patent [19]

Moetteli

[11] Patent Number: 5,924,329

[45] Date of Patent: Jul. 20, 1999

[54] TORQUE-LIMITING MANIPULATION DEVICE

[75] Inventor: John B. Moetteli, Webster, Tex.

[73] Assignee: The United States of America as represented by the Administrator of the National Aeronautics and Space Administration, Washington, D.C.

[21] Appl. No.: 08/789,259

[22] Filed: Jan. 28, 1997

[51] Int. Cl.[6] ..... G05G 11/00

[52] U.S. Cl. ..... 74/490.01; 464/48; 248/418; 901/9

[58] Field of Search ..... 74/490.01; 192/17 R, 192/56.6; 464/48, 45; 901/4, 48, 9; 248/186.2, 418, 415; 396/428

[56] References Cited

U.S. PATENT DOCUMENTS

| | | | |
|---|---|---|---|
| 3,038,576 | 6/1962 | Simpson | 464/48 |
| 3,268,092 | 8/1966 | Hainer et al. | 214/1 |
| 3,656,320 | 4/1972 | Belansky | 64/24 |
| 4,176,733 | 12/1979 | Twickler | 188/134 |
| 4,283,764 | 8/1981 | Crum et al. | 364/513 |
| 4,372,433 | 2/1983 | Mitchell et al. | 192/18 |
| 4,401,426 | 8/1983 | Heidenreich | 464/48 |
| 4,483,429 | 11/1984 | Tiedeman | 192/18 |
| 4,527,446 | 7/1985 | Borodin | 74/828 |
| 4,547,121 | 10/1985 | Nesmith | 414/753 |
| 4,579,201 | 4/1986 | Tiedeman | 192/8 |
| 4,696,150 | 9/1987 | Geeck, III | 56/11.3 |
| 4,860,864 | 8/1989 | Cwycyshyn et al. | 192/56 R |
| 4,995,493 | 2/1991 | Cotsman et al. | 192/150 |
| 5,160,004 | 11/1992 | Scott et al. | 192/17 R |
| 5,366,193 | 11/1994 | Lindsay | 248/183 |
| 5,382,885 | 1/1995 | Salcudean et al. | 318/568.11 |
| 5,688,176 | 11/1997 | Heidernreich et al. | 464/48 |

*Primary Examiner*—Charles A. Marmor
*Assistant Examiner*—David Fenstermacher
*Attorney, Agent, or Firm*—James M. Cate

[57] ABSTRACT

A device for manipulating a workpiece in space includes a fixture, a stanchion assembly, a manipulation mechanism, an actuation mechanism, and a reaction mechanism. The fixture has an end onto which the workpiece affixes. The stanchion assembly has an upper and a lower end. The manipulation mechanism connects the fixture and the upper end of the stanchion assembly. The lower end of the stanchion assembly mounts, via probe and a socket, to a structure. The actuation mechanism operably connects to the manipulation mechanism, and moves the fixture in space. The reaction mechanism provides a point through which force inputs into the actuation mechanism may react.

16 Claims, 6 Drawing Sheets

TORQUE-LIMITING MANIPULATION DEVICE

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435; 42 U.S.C. 2457).

FIELD OF THE INVENTION

This invention relates to a device for manipulating a workpiece attached to a boom assembly, and, more particularly, to a device which includes yaw and pitch torque-limiting mechanisms which stabilize the boom assembly, and permits convenient manual control of a boom assembly about yaw and pitch axes by levers.

BACKGROUND OF THE INVENTION

In many operations, particularly operations involving the manipulation and control of a bulky workpiece in two-dimensional or three-dimensional space, it is sometimes difficult for a handicapped operator (e.g., a paraplegic, or a non-physically challenged person who is otherwise unable to use his or her legs due to adverse conditions, etc.) to locate convenient points against which the operator may react the manipulation forces necessary to control the workpiece. As the workpiece, which the operator is to manipulate, moves, so too do the reaction points, thus making the task of finding suitable reaction points more difficult and sometimes dangerous.

Accordingly, designers of equipment for paraplegic use have devised many alternative ways to permit the operator's hands to compensate for a lack of leg strength. However, these mechanisms are not designed to enable the operator to move, lift, and otherwise reposition bulky or heavy workpieces in a plane or in three-dimensional space.

In addition, designers have designed extra-vehicular activity ("EVA") tools, for use in low-earth orbit spacecraft assembly operations, to eliminate or minimize the fatigue of, and potential danger to, the astronaut during manipulation of a workpiece in space. Such devices have not provided a convenient and safe means of translating a workpiece over distances.

A need therefore exists for a device which permits convenient manipulation of a workpiece which is otherwise freely displaceable in a plane or in three dimensional space, using only the arms and/or hands of the operator.

SUMMARY OF THE INVENTION

A device for manipulating an object in space includes a fixture, a stanchion assembly, a manipulation mechanism, a mounting mechanism, an actuation mechanism, and a reaction mechanism. The fixture has an end onto which the workpiece affixes. The stanchion assembly has a first and a second end. The manipulation mechanism connects the fixture and the first end of the stanchion assembly. The second end of the stanchion assembly mounts, via a mounting mechanism, to a structure. The actuation mechanism operably connects to the manipulation mechanism, and moves the fixture in space. The reaction mechanism provides a point through which force inputs into the actuation mechanism may react.

In another feature of the invention, the manipulation mechanism includes a pitch joint and a yaw joint. Each joint connects to a respective actuation mechanism. The actuation mechanisms move the fixture in pitch or yaw. The reaction mechanism includes reaction levers and handles which provide structures through which force inputs into the actuation mechanism may conveniently react.

In another feature of the invention, the fixture is a boom assembly which includes a mounting end and an engaging end. An engaging mechanism attaches to the engaging end. The engaging mechanism engages the workpiece for translation with the boom assembly.

In another feature of the invention, the pitch and yaw joints each further include a torsionally-yielding structural member and a torque-limiting mechanism which connects between the torsionally-yielding structural member and its associated torsionally-stationary structure. This arrangement enables frictional restraint of the boom assembly against free movement. The torsionally-yielding member is the housing of the corresponding joint. The torsionally-stationary member associated with the pitch joint includes two support arms extending up from the yaw housing. The torsionally-stationary member associated with the yaw joint is the upper end of the stanchion assembly.

Each torque-limiting mechanism includes a torque-limiting clutch disk stack, a driving cup, a clutch hub, a pressure plate, a cover plate, biasing springs, and a shaft. The torque-limiting clutch disk stack includes alternating first clutch disks and second clutch disks. The clutch disks have an inner aperture concentric with an outer circular perimeter. The first clutch disks have outwardly extending tabs, and the second clutch disks have inwardly extending tabs. The driving cup rigidly attaches to the torsionally-yielding member, and includes a relief cut in a sidewall of the driving cup which receives the tabs of the first clutch disks. The clutch hub has an external keyway which receives the tabs of the second clutch disks. The pressure plate mounts in the torsionally-yielding member substantially coaxial with the clutch hub, permits limited axial motion, and prevents rotating motion with respect to the torsionally-yielding member. The biasing springs mount between the cover plate and the pressure plate, thus exerting pressure on the disks of the stack. The shaft nonrotatably mounts to the clutch hub and to the stationary member. The cover plate attaches to the torsionally-yielding member, and closes the torque-limiting mechanism.

An advantage of the present invention is that it is simple to assemble and maintain. This is in part because the manipulation device is manually-driveable, requiring few or no electronic components.

Another advantage of the present invention is that it is simple to operate, requiring only the use of the operators arms and hands.

Another advantage of the present invention is that it securely controls the workpiece during translation, thus minimizing flailing or other unwanted, and often unpredictable oscillation.

Another advantage of the present invention is that the workpiece is positionable anywhere in three-dimensional space, within the extension limits of the manipulation device, while the operator remains in one location.

Another advantage of the present invention is that, in the preferred embodiment, the operator may reposition the boom assembly (and therefore also the workpiece) in pitch and yaw without the operator otherwise being restrained, and, consequently, this affords the operator greater mobility.

Another advantage of the present invention is that the manipulation device and the structure to which the manipulation device attaches are protected from large and potentially destructive forces input into the end of the boom assembly.

DESCRIPTION OF THE PREFERRED EMBODIMENT(S)

Figure 1B:
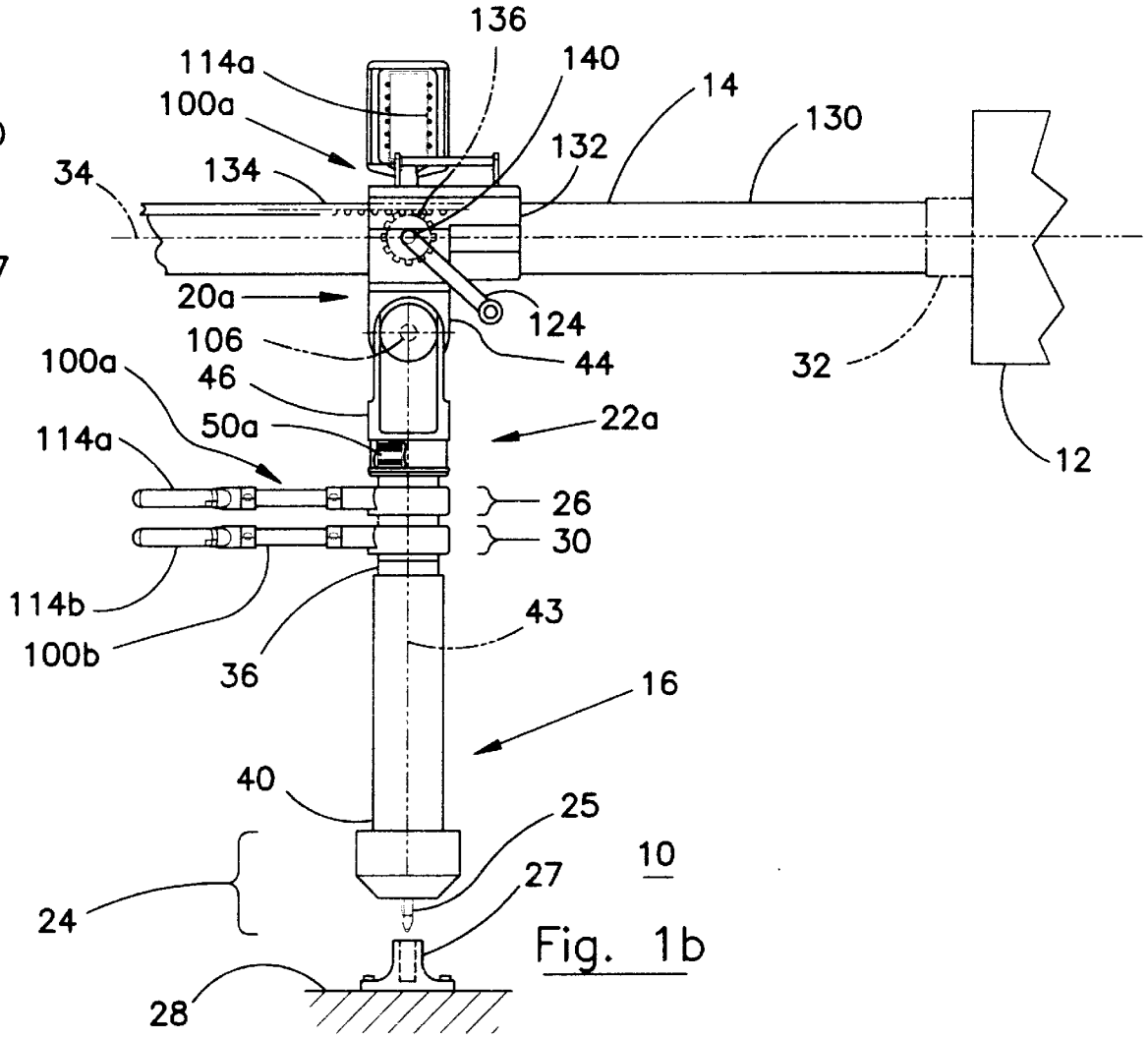
FIG. 1*b* is a partial cut-way, side view of the preferred embodiment of the present invention.
Figure 1A:
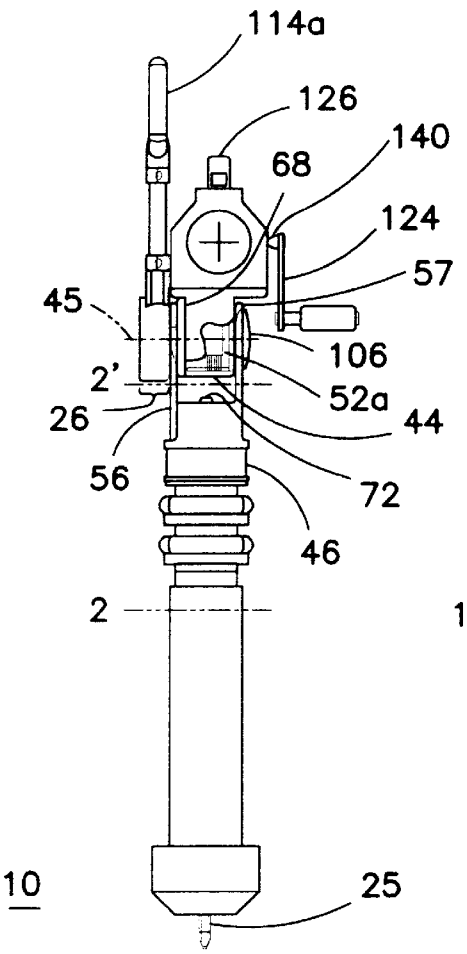
FIG. 1*a* is a partial cut-away, rear view of the preferred embodiment of the present invention.

In FIGS. 1*a* and 1*b*, a manipulation device 10 for manipulating a workpiece 12 in a plane or in three-dimensional space includes a boom assembly 14, a stanchion assembly 16, a pitch joint 20*a* and a yaw joint 22*a*, a mounting unit 24, actuation mechanisms 26, and a reaction mechanism 30. The boom assembly 14 includes an engaging mechanism 32 (shown in phantom) onto which the workpiece 12 affixes for translation along the axis 34 of the boom assembly.

The stanchion assembly 16 has an upper end 36 and a lower end 40. The pitch and yaw joints 20*a* and 22*a* connect the boom assembly 14 and the upper end 36 of the stanchion assembly 16.

The mounting unit 24 includes a probe 25 having a hexagonal cross-section. An upper end of the probe 25 nonrotatably affixes to the mounting unit 24, and a socket 27 receives a lower end of the probe 25. The socket 27 mounts to a structure 28.

The pitch and yaw joints 20*a* and 22*a* each include an actuation mechanism 26 whereby the boom assembly 14 moves about a pitch axis 45 or yaw axis 43. The reaction mechanism 30 includes a reaction lever assembly 100*b* against which the operator may react force inputs into the actuation mechanism 26, and which the operator may relocate about the yaw axis 43. The reaction mechanism 30 will be discussed in more detail below, in connection with FIGS. 3*a*, 3*b*, and 4.

The pitch and yaw joints 20*a* and 22*a* each further include, respectively: a pitch housing 44 and a torque-limiting mechanism 52*a*; and a yaw housing 46, and a torque-limiting mechanism 50*a*. Each of the torque-limiting mechanisms 50*a* and 52*a* acts as a braking clutch, which enables frictional restraint of the boom assembly 14, and prevents undesired movement when an object inadvertently disturbs the manipulation device 10. The housing 44 or 46 of the corresponding joint 20*a* or 22*a*, respectively, forms a torsionally-yielding member. Two support arms 56 and 57, extending up from the yaw housing 46, form a torsionally-stationary member for the pitch joint 20*a*. The upper end 36 of the stanchion assembly 16 forms a torsionally-stationary member for the yaw joint 22.

Figure 2:
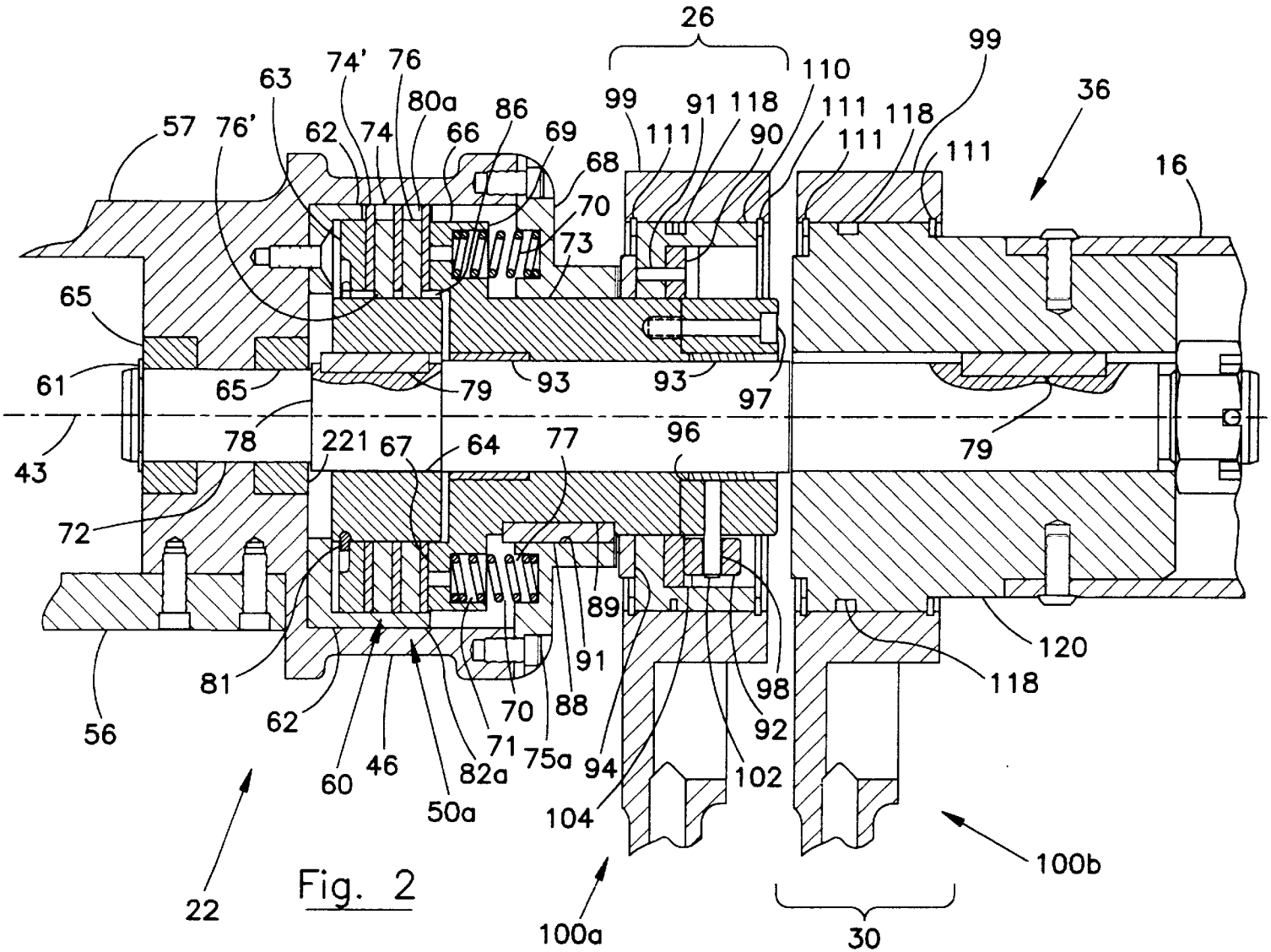
FIG. 2 is a cross-sectional view of the yaw joint of the preferred embodiment of the present invention, taken between lines 2 and 2' in FIG. 1*a*.

Now referring to FIG. 2, wherein according to the present invention, the torque-limiting mechanism 50*a* of the yaw joint 22*a* includes a torque-limiting clutch disk stack 60, a driving cup 62, a clutch hub 64, a pressure plate 66, a cover plate 68, biasing springs 70, a pressure disk 63, and a yaw shaft 72. The torque-limiting clutch disk stack 60 includes alternating first clutch disks 74 and second clutch disks 76. The clutch disks 74 and 76 each have an inner aperture concentric with an outer circular perimeter. The first clutch disks 74 have outwardly extending tabs 74' and the second clutch disks 76 have inwardly extending tabs 76'. The driving cup 62 rigidly attaches to the yaw housing 46, and includes a relief 80*a* cut in a sidewall 82*a* of the driving cup which receives the tabs 74' of the first clutch disks 74. The clutch hub 64 has an external keyway 86 which receives the tabs 76' of the second clutch disks 76. The pressure disk 63 mounts over the clutch hub 64. A retainer 81 mounts in a groove of the clutch hub 64. The retainer 81 retains the pressure disk 63 on the clutch hub 64 and against the clutch disk stack 60. The pressure plate 66 mounts in the yaw housing 46, and includes a disk-contacting surface 67 adjacent the disk stack 60, a flange portion 69 having annularly spaced-apart spring-receiving recesses 71, and a hub portion 73. The cover plate 68 affixes to the housing 46 via fasteners 75*a*, closes the torque-limiting mechanism 50*a*, and constrains the pressure plate 66 to axial translation in coaxial alignment with the clutch hub 64 and the pressure plate. The cover plate 68 further includes spring-receiving recesses 77 which correspond to those of the pressure plate 66. Keyways 89 and 91 contain a key 88 between the pressure plate 66 and the cover plate 68, thereby preventing relative rotation between the pressure plate and the cover plate, yet permitting limited axial motion. Bushings 93 are disposed between the yaw shaft 72 and both the pressure plate 66 and a hub 96, for the purpose of reducing friction and decreasing wear. The biasing springs 70 mount within the spring-receiving recesses 71 and 77, between the cover plate 68 and the pressure plate 66, thus exerting pressure on the disks 74 and 76 of the stack 60. The yaw shaft 72 nonrotatably mounts to the clutch hub 64, and to the upper end 36 of the stanchion assembly 16, via keys 79. Bushings 65 are disposed between the yaw housing 46 and the yaw shaft 72. A retaining ring 61 rotatably constrains the yaw shaft 72 against a shoulder 78.

The actuation mechanism 26 of the yaw joint 22*a* includes a cam ring 90, a cam follower 92, a thrust bushing 94, and a cam housing 110. The cam ring 90 rotatably mounts around the hub portion 73. The hub 96 affixes via fasteners 97 to the hub portion 73. Pins 91 nonrotatably affix the cam ring 90 inside the cam housing 110, thus causing the cam ring to rotate with the cam housing. The cam follower 92 mounts on a follower pin 102 which radially receives in the hub 96. A bushing 98 mounts between the follower pin 102 and the cam follower 92.

Figure 3A:
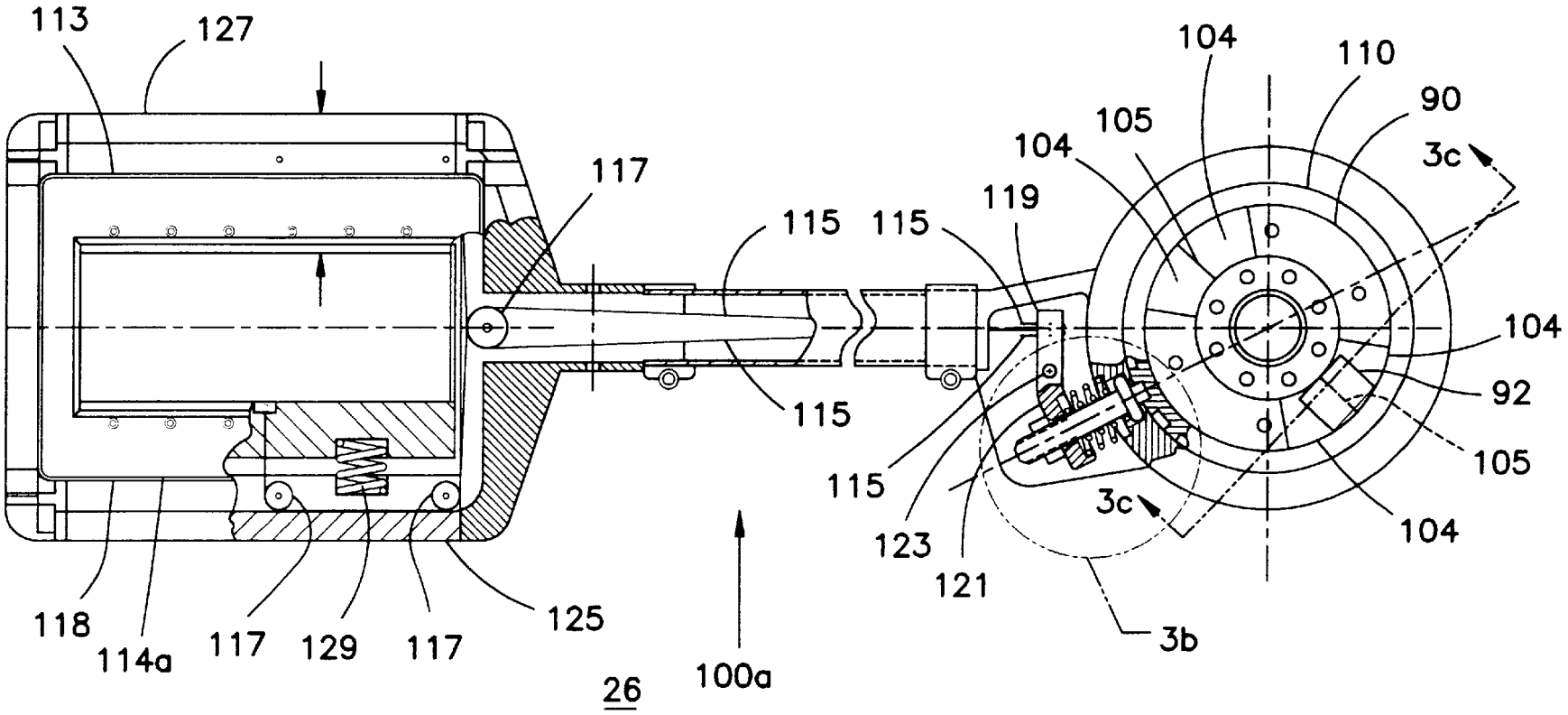
FIG. 3*a* is a partial cut-way, top view of the actuation mechanism of the preferred embodiment of the present invention.
Figure 3B:
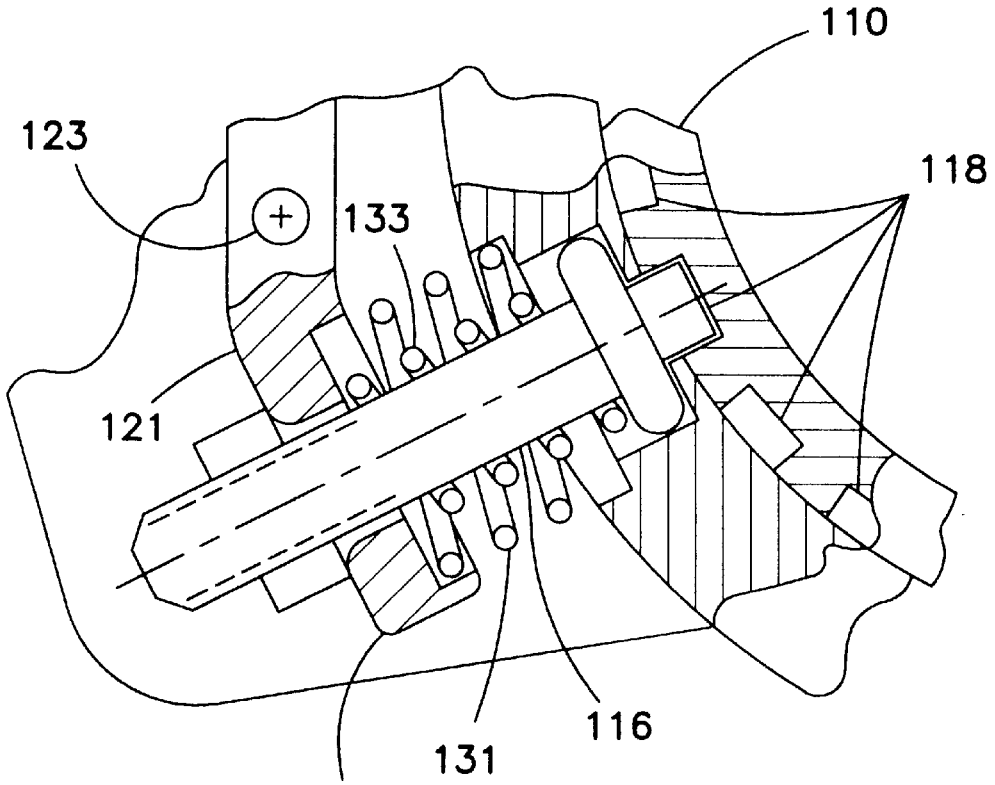
FIG. 3*b* is a detail view of the region of the invention identified in FIG. 3*a*.
Figure 3C:
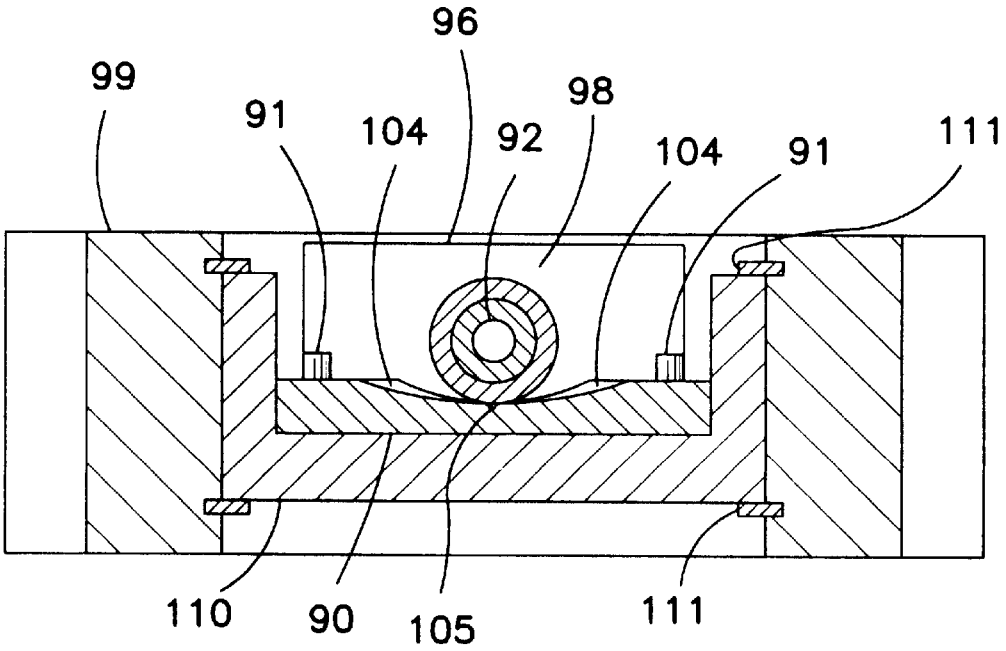
FIG. 3*c* is a cross-sectional view of the invention taken along the line identified in FIG. 3*a*.

The cam follower 92 rides against one of a pair of opposed helical ramps 104 (shown most clearly in FIG. 3*c*). The ramps 104 share a common edge 105 (shown in FIG. 3*a*) over which the cam follower 92 rests. The ramps 104 are integrally formed in the cam ring 90.

The thrust bushing 94 interposes between the cam housing 110 and the cover plate 68 for the purpose of reducing friction to a level that, when combined with the friction between the cam ring 90, cam follower 92, and the follower pin 102, the total torsional-motion resistance which friction generates is less than a return torque. The return torque generates after relative rotation of an actuation lever assembly 100*a*, when the cam follower 92, having rolled up the ramp 104 and thus having separated the disks 74 and 76 which bias together via the biasing springs 70, attempts to return to its lowest energy state in which the cam follower 92 locates at the bottom of the ramps 104 wherein the rotational axis of the cam follower is parallel to the edge 105 (as depicted in FIG. 3*a*) and the disks engage.

Referring again to FIG. 1*a*, the torque-limiting, mechanism 52*a* and the actuation mechanism 26 of the pitch joint 20*a* include identical items and functionally identical items, as compared to the yaw joint 22*a*. In the pitch joint 20*a*, the pitch shaft 106 and pitch housing 44 are functionally identical to the yaw shaft 72 and yaw housing 46. The pitch shaft 106, like the yaw shaft 72, nonrotatably mounts to a clutch hub 64 and to a torsionally-stationary member, which, in this case, includes the two support arms 56 and 57, extending up from the yaw In addition, a cover plate 68 of the pitch joint 20*a* axially restrains a pressure plate 66 (not shown, but identical to that in the yaw housing, 22*a*) of the pitch joint nonrotatably with respect to the corresponding housing 44 in the same manner as does the cover plate 68 of the yaw joint 22*a*. The distinguishing difference between the pitch and yaw joints 20*a* and 22*a* is their orientation with respect to each other: the pitch shaft 106 affixes to the yaw housing 46 at a right angle to the yaw shaft 72.

Referring again to FIG. 2, the cam housing 110 interposes between the cam ring, 90 and the thrust bushing, 94. A repositionable, normally unlocked, actuation lever assembly 100*a* rotatably mounts over the cam housing 110. Retainer rings 111 restrain the actuation lever assembly 100*a* against axial movement with respect to the cam housing, 110.

Now referring to FIGS. 3*a* and 3*b*, opposite sides 113 and 118 of an axially symmetrical hand-lever 114*a* connect to cables 115, which pulleys 117 direct, and which affix to an end 119 of a bell-crank 121. The bell-crank 121 pivots on a pin 123. Springs 129 suspend the hand-lever 114*a* in a middle position, between two cross members 125 and 127. The bell-crank 129 includes a spring-biased pin 116 which passes through an aperture in an end 135 of the bell crank 121. Springs 131 and 133 suspend the pin 116 within the end 135. The cam housing 110 has divots 118 which the pin 116 engages when the operator depresses a cross member 125 or 127 against the adjacent side 113 or 118 of the hand-lever 114*a*. The engagement of the pin 116 into one of the divots 118 locks the actuation lever assembly 100*a* into the cam housing 110, thus preventing rotation of the lever assembly. When the operator releases the hand-lever 114*a* of the lever assembly 100*a*, the pin 116 disengages the divot 118, thus permitting the lever assembly 100*a* to be freely repositioned.

Now referring to FIG. 2, the reaction mechanism 30 includes a reaction hub 120, and the reaction lever assembly 100*b*. The reaction hub 120 affixes to the upper end 36 of the stanchion 16, and is positioned about the yaw axis 43 in a spaced-apart relationship to the yaw actuation mechanism 26. The reaction lever assembly 100*b* is repositionable, and normally unlocked. The reaction lever assembly 100*b* rotatably mounts over the reaction hub 120. Retainer rings 111 restrain the reaction lever assembly 100*b* against axial movement with respect to the reaction hub 120. The reaction hub 120 has divots 118 which are engaged by a spring-biased pin 116 in an identical manner as the pin 116 of the actuation mechanism 26, depicted in FIGS. 3*a* and 3*b*, and described above.

Figure 4:
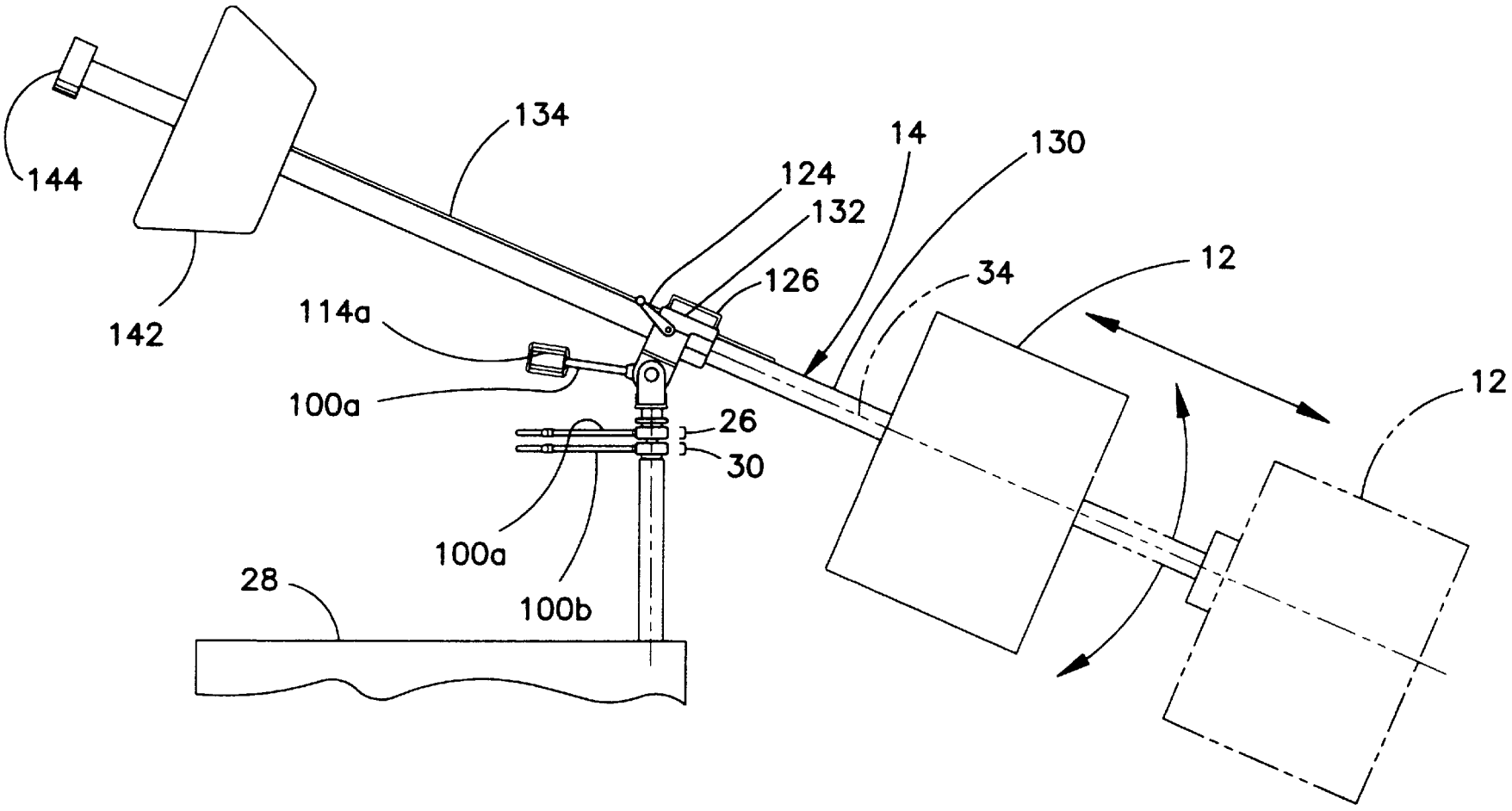
FIG. 4 is a side view of the preferred embodiment of the present invention in operation.

Now referring to FIG. 4, in operation, the boom assembly 14 longitudinally projects and withdraws along axis 34 when an operator rotates a boom extension/retraction crank 124, and reacts against a handle 126 located on the boom assembly or against the reaction lever assembly 100*b*.

Actuating one of the actuation lever assemblies 100*a* against the reaction lever assembly 100*b* adjusts the azimuth or elevation of the boom assembly 14. The actuation lever assemblies 100*a* rotatably move the boom assembly 14 about the yaw axis 43 and the pitch axis 45, and release respective torque-limiting mechanisms 50*a* and 52*a*, transmitting yaw and/or pitch inducing force to the boom assembly 14 through the reaction mechanism 30. The reaction mechanism 30 positions about the yaw axis 43 in a spaced-apart relationship to the actuation mechanism 26 of the yaw joint 22*a*, such that the operator may grasp the actuation lever assembly 100*a* and reaction lever assembly 100*b*, one lever assembly in each hand, squeeze the cross member 125 or 127 against the adjacent side 113 or 118 of the hand-levers 114*a* (shown in FIG. 3*a*), and draw the lever assemblies 100*a* and 100*b* together in a natural, short, arcuate motion which the operator applies in the rotational direction toward which the operator desires that the workpiece 12 or boom assembly 14 translate. The operator then releases his grip on the engagement hand-levers 114*a*, at which time the actuation mechanism 26 and the reaction mechanism 30 automatically disengage from the cam housing 110 and the reaction hub 120, respectively, thus permitting repositioning of the lever assemblies 100*a* and 100*b*. Subsequent engagement enables the repositioning of the boom assembly 14 to continue in a scissor-like fashion. When the boom assembly 14 reaches the desired azimuth or elevation (i.e., it is targeted toward a destination point), the operator releases his grip on the engagement hand-lever 114*a*, causing the disks 74 and 76 of the torque-limiting mechanism 50*a* or 52*a* to engage, thus slowing and eventually stopping the workpiece 12. This permits actuation while minimizing unbalanced reactive forces which tend to dislocate the operator, the result being greater mobility and flexibility in performing maintenance tasks.

Referring again to FIGS. 3*a* and 3*b*, movement of the side 113 or 118 of the hand-levers 114*a* or 114*b* (as shown in FIG. 1*b*) away from the middle position and toward the adjacent cross member 125 or 127 causes one of the cables 115 to draw the end 119 toward the respective hand-lever, and thus the end 135 radially inward toward the cam housing 110, or, as the case may be, the reaction hub 120. This then engages a spring-biased pin 116 into a divot 118 in the cam housing 110 or the reaction hub 120, and locks the lever assembly 100*a* or 100*b* into the cam housing, or the reaction hub 120.

The cam follower 92 is in a lowest energy state when the cam follower 92 is resting at the bottom of the ramps 104. In this position, the rotational axis of the cam follower 102 is parallel to the edge 105, and the disks 74 and 76 are engaged. Relative rotation of the lever assembly 100*a* generates a return torque as the cam follower 92, having rolled up the ramp 104, and thus having separated the disks 74 and 76 which bias together via the biasing springs 70, attempts to return to the lowest energy state. This arrangement permits both unlocking and positioning of the boom assembly in one smooth motion.

Referring again to FIGS. 1*a* and 1*b*, torque-limiting mechanisms 50*a* and 52*a* limit the torque input into the pitch and yaw joints 20*a* and 22*a*, whereby positioning forces which an operator (e.g., a paraplegic, a seated person, an astronaut, or a diver) applies to the end of the boom assembly 14 or the workpiece 12 are effective to reposition the boom assembly 14 when such forces exceed the limits of the torque-limiting mechanisms, thus permitting micro-adjustment of the workpiece at the destination point, and avoiding over-stressing the manipulation device 10, or the structure 28.

Referring again to FIG. 2, the spring rate of the biasing springs 70, the preload of the biasing springs, and the surface area and number of clutch disks 74 and 76 used in the stack 60 determine the torque limits of the torque-limiting mechanisms 50*a* and 52*b*.

Referring again to FIGS. 1*a* and 1*b*, the boom assembly 14 includes a boom 130, a housing 132, a rack 134, a mating extension/retraction gear 136, a shaft 140, the crank 124, a counterweight 142 (shown in FIG. 4), and a stop 144 (shown in FIG. 4). The crank 124 and the gear 136 attach to the shaft 140. The gear 136 axially slides between engagement with the rack 134 and a boom extension mechanism (not shown). A channel 146 contains a rack 134 which connects to the counterweight 142, such that movement of the rack causes corresponding movement of the counterweight. The counterweight 142 slidably mounts to the boom 130. The stop 144 mounts to an end of the boom 130. The operator rotates the crank 124, extending the boom 130 to a desired destination point. The engagement mechanism engages the workpiece 12. The operator locks the boom 130 against further axial movement within the housing 132, and slides the shaft into the housing a pre-determined distance sufficient to disengage the boom extension mechanism (not shown), and engage the rack 134. The operator rotates the crank 124, thus causing the rack 134 to slide within the channel 146 (not shown) of the boom 130, and imparting corresponding motion to the counterweight 142. The channel 146 runs parallel to the axis 34. By rotating the crank 132, the operator counterbalances the boom assembly 14 with the workpiece 12, and neutralizes the effects of gravity, thus enabling manipulation of the workpiece in non-neutrally buoyant or non-weightless environments.

An advantage of the present invention is that it is simple. This is in part because the manipulation device 10 is manually-driveable. Therefore, few or no electronic components are required.

Another advantage of the present invention is that it securely controls the workpiece 12 to be translated, thus minimizing flailing or other unwanted and often unpredictable oscillation.

Another advantage of the present invention is that the workpiece 12 is repositionable anywhere in space, within the extension limits of the manipulation device 10, without first having to spend a substantial amount of time in setting up the manipulation device.

Another advantage of the present invention is that the boom assembly 14 (and therefore also the workpiece 12) is repositionable about pitch and yaw axes in a convenient fashion. Such is accomplished by first engaging and actuating the lever assembly 100*a*, in a natural, short, arcuate motion which the operator applies in the rotational direction toward which the operator desires that the workpiece 12 or boom assembly 14 translate. This permits actuation while minimizing unbalanced reactive forces which tend to dislocate the operator, the result being greater mobility and flexibility in performing maintenance tasks.

Another advantage of the present invention is that micro-adjustment of the workpiece 12 or the end of the boom assembly 14 is permitted at the destination point.

Another advantage of the present invention is that the structure 28, to which the manipulation device 10 attaches, is protected from large and potentially destructive forces input into the end of the boom assembly 14.

Another advantage of the present invention is that the lever assemblies 100*a* and 100*b* are normally free to rotate about their respective axis until the operator squeezes the hand-lever 114. This ensures that accidental rotation of the lever through bumping or other contact does not actuate the actuation mechanisms 26, thus avoiding imparting unwanted and possibly destructive motion-inducing forces to the workpiece 12.

It is understood that the present invention can take many forms and embodiments. The embodiments shown here illustrate rather than limit the invention. Others may make variations without departing from the spirit or the scope of the invention, such as that which FIG. 5 depicts.

Figure 5:
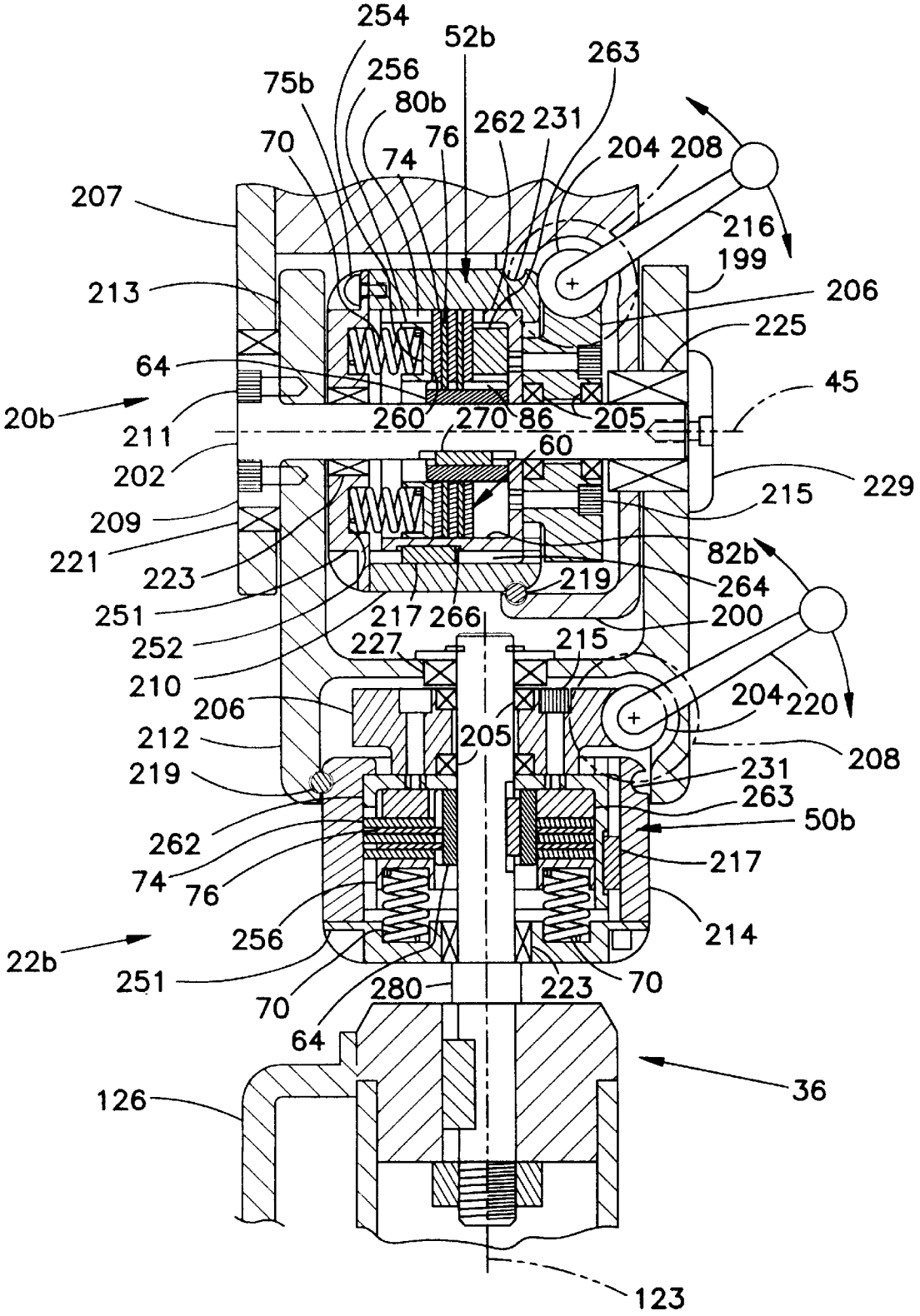
FIG. 5 is a partial cross-sectional view of the pitch and yaw joints of an alternate embodiment of the present invention.

In FIG. 5, the actuation mechanism associated with each joint 20*b* and 22*b* is a worm gear drive. In addition to the torque-limiting mechanisms 50*b* and 52*b*, the pitch and yaw joints 20*b* and 22*b* each further include a corresponding gear housing 200 and 212, respectively, and a worm 204 and mating worm gear 206. In addition, pitch and yaw actuation cranks 216 and 220 attach to the respective worm 204, such that rotation of the pitch or yaw crank 216 and 220 causes rotation of the corresponding joint 20*b* or 22*b*.

The pitch and yaw joints 20*b* and 22*b* each include, respectively: a pitch housing 210 having a torque-limiting mechanism 52*b*; and a yaw housing 214 having a torque-limiting mechanism 50*b*, which are disposed within each housing. Each torque-limiting mechanism 50*b* and 52*b* frictionally restrains the boom assembly 14 against free movement, and limits the torque inputs into the structure 28 when an object inadvertently disturbs the manipulation device 10. Two support arms 199 and 213 extending up from the yaw gear housing 212 form the torsionally-stationary member of the pitch joint 20*b*. The upper end 36*b* of the stanchion assembly 16*b* forms the torsionally-stationary member of the yaw joint 22*b*. Retainer pins 219 are disposed in annular grooves 231, and rotatably retain the yaw gear housing 212 and pitch gear housing 200 onto their respective housing 214 or 210.

The pitch joint 20*b* includes the pitch gear housing 200 which rotatably affixes to the pitch shaft 202. A bearing 225 mounts between an end of the pitch shaft 202 and the support arm 199. A bearing cap 229 fastens to the pitch shaft 202, and retains the bearing 225 in place. The flange 209 of the pitch shaft 202 fastens via fasteners 211 to the support arm 213. A support arm 207 has an aperture in an end into which the flange 209 of the pitch shaft 202 mounts. A bearing 221 mounts between the flange 209 and the support arm 207. An opposite end of the support arm 207 rigidly fastens to the pitch gear housing 200. The worm 204 rotatably mounts on bearings (not shown) in the pitch gear housing 200. The mating worm gear 206 nonrotatably attaches to a pitch housing 210 via fasteners 215 which fasten to a driving cup 262. The driving cup 262 nonrotatably engages the pitch housing 210 via a key 217. The pitch gear housing 200 houses the mating worm gear 206. Bearings 205 support the mating worm gear 206.

As in the preferred embodiment, a torque-limiting clutch disk stack 60 includes alternating first clutch disks 74 having outwardly extending tabs 74' and second clutch disks 76 having inwardly extending tabs 76'. The driving cup 262 rigidly attaches to the pitch housing 210, and includes a relief 80*b* cut in a sidewall 82*b* of the driving cup which receives the tabs 74' of the first clutch disks 74. A clutch hub 64 has an external keyway 86 which receives the tabs 76' of the second clutch disks 76. The pressure disk 263 are disposed between the driving cup 262 and the clutch disk stack 60. In a manner similar to that of the preferred embodiment, a pressure plate 256 mounts in the pitch housing 210, and includes a disk-contacting surface 260 adjacent the disk stack 60 and annularly spaced-apart spring-receiving recesses 254. A cover plate 251 affixes to the housing 210, via fasteners 75*b*, thereby enclosing the torque-limiting mechanism 50*b*. A bearing 223 mounts between the cover plate 251 and the pitch shaft 202. The cover plate 251 further includes spring-receiving recesses 252 which correspond to those in the pressure plate 256. The key 217 is disposed between the pitch housing 210 and the driving cup 262 within respective keyways 264 and 266 of both the pitch housing 210 and the driving cup 262, thereby preventing relative rotation between the pressure plate and the cover plate, yet permitting limited axial motion. The biasing springs 70 mount within the spring-receiving recesses 252 and 254, between the cover plate 251 and the pressure plate 256, thus exerting pressure on the disks 74 and 76 of the stack 60. The pitch shaft 202 nonrotatably mounts to the clutch hub 64, via a key 270. The yaw joint 22*b* includes the yaw gear housing 212 which rotatably affixes to the yaw housing 214. Bearings 227 and 223 support a yaw shaft 280 in the yaw housing 214.

Unlike the actuation mechanism 26 of the preferred embodiment, the worm 204 rotatably mounts in the yaw gear housing 212. The mating worm gear 206 nonrotatably attaches to the yaw housing 214. The yaw gear housing 212 houses the mating worm gear 206. The torque-limiting mechanism of the yaw housing 214 is, in functional essentials, the same as that of the pitch housing 210.

In further embodiments, the worm 204 and worm gear 206 may be double enveloping, thereby reducing contact forces by permitting a larger area of contact between the worm 204 and the worm gear 206. A suitable double enveloping worm gear pair is "CONE DRIVE" available from Cone Drive Textron, Inc., of Traverse City, Mich.

In another embodiment, controllable gear motors 208 (shown in phantom) may be used in conjunction with, or as a substitute for, the pitch and yaw actuation cranks 216 and 220. The controllable gear motors 208 attach to each worm 204, such that rotation of the controllable gear motors causes rotation of the corresponding joint 20*b* or 22*b*.

In still further embodiments, a load alleviator 250 alleviates torsional loads about the yaw axis 43.

The above-described embodiments have many advantages over the prior art. For example, the advantages of the preferred embodiment also apply to the alternate embodiment, with the exception that the operator inputs rotational motion into the crank handles 216 and 220, rather than more natural, short, arcuate motion in the direction toward which the operator desires that the workpiece 12 or boom assembly 14 move.

Although the illustrative embodiments above describe the invention, a wide range of modification, change, and substitution is obvious to those of ordinary skill in the art. In some instances, some features of the present invention are independent of other corresponding features. Accordingly, it is appropriate that one construe the appended claims broadly and in a manner consistent with the scope of the invention.

INDUSTRIAL APPLICABILITY

In addition to its applicability to workpiece manipulation as depicted in FIG. 4, the manipulation device 10 of the present invention is useful for transferring, repositioning and stowing fixtures, shielding, equipment and/or tools for deep-sea structural maintenance operations on off-shore oil drilling rigs and platforms, or ship hulls. In addition, the torque-limiting mechanism 50*a* or 52*a* of the preferred embodiment is useful in antennae or satellite dish structures which may require repositioning in a neutrally buoyant environment or in an environment where it is difficult to react against another fixed structure (e.g. repositionable joints on parabolic dish antennae or telescopes in a field environment in which it may be difficult for the user to otherwise obtain a sure footing, for example, icy or muddy conditions). The actuation mechanism of the preferred embodiment has wide application in joining low speed industrial machinery which require adjustment while the machinery is operating. For example, the sun gear in a planetary gear arrangement may be repositioned while the device is operating through a simple, manual adjustment. The invention may also be used to reposition large power-generating wind mills in a controlled manner.

What is claimed is:

1. A device for manipulating an object, the device comprising:

a fixture having an end onto which the object affixes;

a stanchion assembly having a first and second end;

a manipulator connecting the fixture and the first end of the stanchion assembly;

a mounting device for mounting the second end of the stanchion assembly to a structure;

an actuator operably connected to the manipulator for moving the fixture;

a reactor through which force inputs into the actuator may react;

wherein the manipulator comprises a pitch joint and a yaw joint, each joint comprising:

a torsionally-stationary and a torsionally-yielding structural member; and a torque-limiting mechanism which connects between the torsionally-stationary and the torsionally-yielding structural member, for frictionally restraining the device against free movement, each torque-limiting mechanism including:

a torque-limiting clutch disk stack including an alternating stack of first clutch disks and second clutch disks, the clutch disks having an inner aperture concentric with an outer circular perimeter, wherein the first clutch disks have outwardly extending tabs, and the second clutch disks have inwardly extending tabs;

a driving cup rigidly attached to the torsionally-yielding member, the driving cup having a relief cut in a sidewall thereof which receives the tabs of the first clutch disks;

a clutch hub having an external keyway which receives the tabs of the second clutch disks;

a pressure plate which mounts in the torsionally-yielding member substantially coaxial with the clutch hub, permits limited axial motion, and prevents rotating motion with respect to the torsionally-yielding member;

a cover plate which attaches to the torsionally-yielding member, closing the torque-limiting mechanism;

biasing springs which mount between the cover plate and the pressure plate, and exert pressure on the disks of the stack; and a shaft which nonrotatably mounts to the clutch hub and to the stationary member.

2. The device of claim 1, wherein the actuator with which each joint associates is a worm gear drive, the joints each further comprising:

a rotatable housing which rotatably affixes to the torsionally-yielding member, the rotatable housing having a worm which rotatably mounts in the housing, and a mating worm gear, the worm gear nonrotatably attaching to the torsionally-yielding member.

3. The device of claim 2, wherein each worm and worm gear has a double involute profile.

4. The device of claim 1, wherein each torque-limiting mechanism further comprises:

a cam ring rotatable around a hub of the pressure plate by means of a lever;

a cam follower which mounts on a follower pin which receives in the pressure plate, the cam follower riding against a helical ramp on the cam ring;

a thrust bushing which interposes between the cam ring and the cover plate, and reduces friction between the cam ring and the cover plate to an extent that when the friction combines with the friction between the cam ring, the cam follower, and the follower pin, the torsional resistance to rotational motion which the friction generates is less than the return torque which relative rotation of the lever generates when the cam follower, having rolled from a rest position up a ramp of the cam ring and thus having separated the disks which bias together via the biasing springs, attempts to return to its lowest energy state in which the cam follower locates at the rest position, and the disks engage;

the shaft of the pitch joint affixing to the torsionally-yielding member of the yaw joint at a right angle to the shaft of the yaw joint, and the cover plate axially restraining the pressure plate nonrotatably with respect to the torsionally-yielding member.

5. The device of claim 4, further comprising a cam housing which affixes to the cam ring, and interposes between the cam ring and the thrust bushing, and a repositionable, actuation lever assembly which rotatably mounts over the cam housing, the cam housing having divots which a spring-biased pin engages when a hand-lever of the lever assembly depresses, thereby locking the actuation lever assembly into the cam ring such that rotation of the actuation lever assembly causes rotation of the cam ring.

6. The device of claim 5, further comprising a reaction hub which affixes to the stationary member, and a repositionable, reaction lever assembly which rotatably mounts over the reaction hub, the reaction hub having divots which a spring-biased pin engages when a hand-lever of the reaction lever assembly depresses, thereby locking the reaction lever assembly into the reaction hub, and preventing rotation of the reaction lever assembly.

7. The device of claim 1, wherein the actuator with which each joint associates is a worm gear drive, the joints each further comprising:

a rotatable housing which rotatably affixes to the torsionally-yielding member, the rotatable housing having a worm which mounts in the housing, and a mating worm gear, the worm gear nonrotatably attaching to the torsionally-yielding member.

8. A manually powered device for supporting and manipulating an object, the device comprising:

a fixture having an end onto which the object affixes;

a stanchion assembly having a first and second end;

a manipulator connecting the fixture and the first end of the stanchion assembly;

a mounting device for mounting the second end of the stanchion assembly to a structure;

a manually powered actuator operably connected to the manipulator for moving the fixture in response to force exerted by an operator;

a reactor through which force inputs into the actuator may react, wherein the manipulator comprises a pitch joint and a yaw joint, each joint comprising:

a torsionally-stationary and a torsionally-yielding structural member; and a torque-limiting mechanism which connects between the torsionally-stationary and the torsionally-yielding structural member, for frictionally restraining the device against free movement.

9. A device for supporting and manipulating an object, the device comprising:

a fixture having an end onto which the object affixes;

a stanchion assembly having a first and second end;

a manipulator connecting the fixture and the first end of the stanchion assembly;

a mounting device for mounting the second end of the stanchion assembly to a structure;

an actuator operably connected to the manipulator for moving the fixture;

a reactor through which force inputs into the actuator may react, wherein the manipulator comprises a pitch joint and a yaw joint, each joint comprising:

a torsionally-stationary and a torsionally-yielding structural member; and a torque-limiting mechanism which connects between the torsionally-stationary and the torsionally-yielding structural member, for frictionally restraining the device against free movement, wherein the fixture comprises a linearly translatable boom assembly having a longitudinal axis and an end onto which an object affixes for linear translation with the boom assembly.

10. A torque-limiting manipulation joint, comprising a torsionally-stationary and a torsionally-yielding structural member and a torque-limiting mechanism which connects between the torsionally-stationary and the torsionally-yielding structural member, and frictionally restrains the joint against free movement, the torque-limiting mechanism including:

a torque-limiting clutch disk stack including an alternating stack of first clutch disks and second clutch disks, the clutch disks having an inner aperture concentric with an outer circular perimeter, wherein the first clutch disks have outwardly extending tabs, and the second clutch disks have inwardly extending tabs;

a driving cup rigidly attached to the torsionally-yielding member, the driving cup having a relief cut in a sidewall thereof which receives the tabs of the first clutch disks;

a clutch hub having an external keyway which receives the tabs of the second clutch disks;

a pressure plate which mounts in the torsionally-yielding member substantially coaxial with the clutch hub, permits limited axial motion, and prevents rotating motion with respect to the torsionally-yielding member;

a cover plate which attaches to the torsionally-yielding member, closing the torque-limiting mechanism;

biasing springs which mount between the cover plate and the pressure plate, and exert pressure on the disks of the stack; and a shaft which nonrotatably mounts to the clutch hub and to the stationary member.

11. The device of claim 10, wherein each torque-limiting mechanism further comprises:

a cam ring rotatable around a hub of the pressure plate by means of a lever;

a cam follower which mounts on a follower pin which receives in the pressure plate, the cam follower riding against a helical ramp on the cam ring;

a thrust bushing which interposes between the cam ring and the cover plate, and reduces friction between the cam ring and the cover plate to an extent that when the friction combines with the friction between the cam ring, the cam follower, and the follower pin, the torsional resistance to rotational motion which the friction generates is less than the return torque which relative rotation of the lever generates when the cam follower, having rolled from a rest position up a ramp of the cam ring and thus having separated the disks which bias together via the biasing springs, attempts to return to its lowest energy state in which the cam follower locates at the rest position, and the disks engage;

the shaft of the pitch joint affixing to the torsionally-yielding member of the yaw joint at a right angle to the shaft of the yaw joint, and the cover plate axially restraining the pressure plate nonrotatably with respect to the torsionally-yielding member.

12. A device for positioning an object, comprising:

a boom structure having first and second end portions, the second end portion having connecting means for releasably connecting the object to the boom structure;

a support structure;

an articulated connecting means mounted on the support structure, and connected to the first end portion of the boom structure; the connecting means having a pitch joint, for permitting movement of the boom structure about the pitch axis, and a yaw joint, for permitting movement of the boom structure about a yaw axis;

actuator associated with the pitch joint and the yaw joint for moving the boom assembly in pitch and yaw;

a torque-limiting means associated with the pitch joint and the yaw joint, the torque-limiting means limiting a torque which an operator may input into the pitch and yaw axes; and a reactor on the device through which force inputs into the actuator may react.

13. The device of claim 12, wherein the torque-limiting means connects between a torsionally-stationary and a torsionally-yielding structural member, and frictionally restrains the object against movement about the pitch and yaw axes, respectively, the torque-limiting means including:

clutch means for transmitting preselected torsional forces to the boom; and actuator operatively connected to the clutch means for imparting a torsional motion-inducing force into the respective joint.

14. The device of claim 13, further comprising a manually operable clutch release mechanism which connects between the actuator and the clutch means, and which disengages the clutch means, enabling the respective joint to be repositioned about the respective axis.

15. The device of claim 14, further comprising a manually operable reaction mechanism connected to the support structure, the reaction mechanism providing a rigid structure through which force imparted into the actuator by an operator may react.

16. A method for positioning an object utilizing a device comprising:

a boom structure having first and second end portions, the second end portion having connecting means for releasably connecting the object to the boom structure;

a support structure;

articulated connecting means mounted on the support structure, and connected to the first end portion of the boom structure; the connecting means having a pitch joint for permitting movement of the boom structure about a pitch axis and a yaw joint for permitting movement of the boom structure about a yaw axis;

an actuator associated with the pitch joint and the yaw joint, for moving the boom assembly in pitch and yaw; and a reactor on the device through which force inputs into the actuator may react;

wherein the pitch joint and the yaw joint each comprise a torsionally-stationary and a torsionally-yielding structural member, and a torque-limiting mechanism connects therebetween, the torque-limiting mechanism fictionally restraining the object against movement about the pitch and yaw axes, respectively; the method comprising the following steps:

(i) gripping the actuator;

(ii) engaging the actuator to the torque-limiting mechanism;

(iii) imparting a first and a second rotational motion to the actuator, the first rotational motion releasing the respective torque-limiting mechanism, and the second rotational motion imparting motion to the torsionally-yielding structural member relative to the respective torsionally-stationary structural member;

(iv) discontinuing rotational motion of the actuator; and (v) automatically engaging the respective torque-limiting mechanism, thereby bringing the object to a torque-limited stop at a destination point.

* * * * *